US008205361B2

(12) United States Patent
Azure et al.

(10) Patent No.: US 8,205,361 B2
(45) Date of Patent: Jun. 26, 2012

(54) WALK-BEHIND TRENCHING MACHINE

(75) Inventors: John P. Azure, Bloomington, MN (US); Tanner L. Erickson, St. Paul, MN (US); Glenn D. Liubakka, Andover, MN (US)

(73) Assignee: The Toro Company, Bloomington, MN (US)

( * ) Notice: Subject to any disclaimer, the term of this patent is extended or adjusted under 35 U.S.C. 154(b) by 0 days.

(21) Appl. No.: 13/195,367

(22) Filed: Aug. 1, 2011

(65) Prior Publication Data

US 2011/0283570 A1 Nov. 24, 2011

Related U.S. Application Data

(63) Continuation of application No. 12/869,187, filed on Aug. 26, 2010, now Pat. No. 8,015,733, which is a continuation of application No. 12/329,096, filed on Dec. 5, 2008, now Pat. No. 7,805,864, which is a continuation of application No. 11/900,394, filed on Sep. 11, 2007, now Pat. No. 7,644,524.

(51) Int. Cl.
*E02F 3/28* (2006.01)

(52) U.S. Cl. ..... 37/355

(58) Field of Classification Search ..... 37/142.5, 37/352, 355, 357, 366, 367, 139, 462, 465, 37/347, 387, 91, 92; 172/329, 40, 42, 245, 172/247; 414/680, 685, 686
See application file for complete search history.

(56) References Cited

U.S. PATENT DOCUMENTS

| | | | |
|---|---|---|---|
| 3,087,354 | A | 4/1963 | Malzahn |
| 3,750,762 | A | 8/1973 | Eaton |
| 4,322,899 | A | 4/1982 | Clune |
| 4,794,708 | A | 1/1989 | Schroeder et al. |
| 5,228,221 | A | 7/1993 | Hillard et al. |
| 6,151,811 | A | 11/2000 | Barreto |
| 6,163,987 | A | 12/2000 | Schommer |
| 6,338,209 | B1 | 1/2002 | McClure |
| 6,415,532 | B1 | 7/2002 | Bricko et al. |
| 6,658,768 | B1 | 12/2003 | Bainter |
| 6,698,114 | B2 | 3/2004 | Bares et al. |
| 6,709,223 | B2 | 3/2004 | Walto et al. |
| 6,830,111 | B2 | 12/2004 | Page |
| 6,832,443 | B1 | 12/2004 | Piel et al. |
| 6,832,659 | B1 | 12/2004 | Bares et al. |
| 6,860,043 | B1 | 3/2005 | Heise et al. |
| 7,644,524 | B2 | 1/2010 | Azure et al. |
| 7,805,864 | B2 | 10/2010 | Azure et al. |
| 2005/0011696 | A1 | 1/2005 | Bares et al. |
| 2010/0313452 | A1 | 12/2010 | Azure et al. |

OTHER PUBLICATIONS

"All Hydraulic Mini Heavy Duty Trencher," Models 912HM and 912RM. Barreto Manufacturing, Inc. [Online]. [retrieved on May 22, 2007]. Retrieved from the Internet: <URL:http://www.barretomfg.com/mini-heavy-duty-trencher.php>; 1 pg.

(Continued)

*Primary Examiner* — Robert Pezzuto
(74) *Attorney, Agent, or Firm* — Mueting, Raasch and Gebhardt, P.A.

(57) ABSTRACT

A walk-behind trenching vehicle incorporating a trenching boom with an endless trenching chain. The trenching boom may be connected to a forward end of the vehicle via a dual pivot mechanism. The boom may be movable between an operating position and a transport position via a single actuator, e.g., hydraulic cylinder.

20 Claims, 10 Drawing Sheets

OTHER PUBLICATIONS

"Attachments: Kid Standard Trencher," Kanga-Loader. [Online]. [retrieved on May 22, 2007]. Retrieved from the Internet: <URL:http://www.kanga-loader.com/2005/general/attachments_print.php?type=Kid&section=Trenchers &attachment=Standard%20Trencher>; 1pg.

"Document 1," 8 pictures of a trenching machine taken at Northwest Rental Conference trade show, Pasco, WA, Nov. 5-7, 2007; 6 pgs.

"Document 2," picture of Toro Dingo Model 22306 Loader with Trencher Attachment, combination available at least as early as 2001, 1 pg.

Product Brochure for "L2 Line Layer for Irrigation and Cable Installation," Line Ward Corporation, [Online]. [retrieved on Oct. 25, 2007]. Retrieved from the Internet:<URL:http://www.lineward.com/pdf/L2_brochure.pdf>; 6 pgs.

Product Brochure for "Toro® Dingo® Compact Utility Loaders," The Toro Company, Available Aug. 25, 2006; 22 pgs.

Product Brochure for "Zero Turning Radius Steerable Walk-Behind Trencher," Models: Barreto 1324ST/1624ST, Barreto Manufacturing, Inc.; 2 pgs. Product believed to be introduced at least as early as Feb. 9, 2007.

Product Brochure for "Barreto 912 Self-Propelled Trencher," Barreto Manufacturing, Inc.; 2 pgs. Product believed to be introduced at least as early as Feb. 2005.

"Kid Trencher (2 series Photos)," [online]. May 10, 2007 [retrieved on Apr. 24, 2008]. Kanga Loaders UK Ltd., Retrieved from the Internet:<URL:http:www.kangaloader.co.uk/photodetails.asp?category=2%20Series%20Photos&PhotoID=37>; 1 pg.

"Kid Augering (2 Series Photos)," [online]. May 10, 2007 [retrieved on Apr. 24, 2008]. Kanga Loaders UK Ltd. Retrieved from the Internet: <URL:http:www.kangaloader.co.uk/photodetails.asp?category=2%20Series%20Photos&PhotoID=43>; 1 pg.

"L2-Line Layer," [Online]. [retrieved on Oct. 25, 2007]. Line-Ward Corporation. Retrieved from the Internet: <URL:http://web.archive.org/web/20060510011736/www.lineward.com/12-line.htm>, web archive dated May 10, 2006; 1 pg.

"SAE J1382 Surface Vehicle Standard—Classification, Nomenclature, and Specification Definitions for Trenching Machines," SAE International™, May 1982;10 pgs.

The Toro® Company, "Operator's Manual High Torque Trencher Head and High Speed Trencher Head for Compact Utility Loaders Model Nos. 22470-250000001 & Up and 22471-250000001 & Up," Form No. 3353-890 Rev A; The Toro Company; Bloomington, MN; 2005; 20 pgs.

"2 Series Photo #1 (2 series Photos)," [online]. Apr. 30, 2007[retrieved on Apr. 24, 2008]. Kanga Loaders UK Ltd., Retrieved from the Internet: <URL:http:www.kangaloader.co.uk/photodetails.asp?category=2%20Series%20Photos&PhotoID=20>; 1 pg.

WALK-BEHIND TRENCHING MACHINE

This application is a continuation of U.S. Application No. 12/869,187, filed Aug. 26, 2010, which is a continuation of U.S. Application No. 12/329,096, filed Dec. 5, 2008, which is a continuation of U.S. Application No. 11/900,394, filed Sep. 11, 2007, all of which are incorporated herein by reference in their respective entireties.

TECHNICAL FIELD

The present invention relates generally to ground working equipment and, more particularly, to a compact, walk-behind machine of a dedicated or limited function, e.g., trenching.

BACKGROUND

Ride-on and walk-behind loader vehicles are generally known in the art. One such vehicle is illustrated and described in U.S. Pat. No. 6,709,223 to Walto et al. While exact designs may vary, these utility loaders typically include differential drive members to propel and turn the vehicle (e.g., skid-steer vehicles), and a forward-mounted attachment plate configured to receive an array of excavating or other ground working attachments. For example, lift buckets, augers, snow throwers, trenchers, and vibratory plows may couple to the attachment plate. The loader, in turn, may manipulate the attachment plate, and thus the attachment, as desired during operation.

While extremely effective and versatile, these convertible loaders may be relatively sophisticated in their construction in order to accommodate and function with the broad range of potential attachments. For example, many walk-behind loaders include hydraulic lift cylinders that raise and lower the attachment plate relative to the ground, as well as one or more tilt cylinders to change the angle of inclination of the attachment plate.

To address industry need, manufacturers have introduced simplified vehicles that accept fewer attachments or, in some instances, are designed for a single, dedicated use. For example, some landscape professionals may require only trenching capability (e.g., for burying irrigation pipe, conduit, and the like). An exemplary walk-behind trenching machine is illustrated in U.S. Pat. No. 5,228,221 to Hillard et al.

While different configurations exist, dedicated trenchers often include spaced-apart and independently powered drive wheels, and a forwardly extending boom pivotally attached to the trencher. The boom may include an endless trenching chain that moves along the boom, much like a chain saw, under power of a horizontal, driven trencher axle. Most dedicated trenchers, in addition to their smaller size, may incorporate simplified controls and hydraulic circuitry as compared to conventional convertible loaders with a trencher attachment.

While effective for their intended use, many dedicated trenchers have drawbacks. For example, the trencher axle is typically located close to the ground to maximize trench depth relative to boom length. As a result, when the boom pivots upwardly (about the trencher axle) for transport, the rear, lower portion of the boom and chain remain in close proximity to the ground. In order to permit transport of the trencher in this configuration, e.g., traversal of curbs or ramped surfaces, and/or to accommodate a forwardly biased center of gravity, a trailing wheel is typically provided and located forward of the aft end of the boom. The trailing wheel is beneficial as it contacts elevated ground surfaces (e.g., curbs and ramps) first, thereby limiting or preventing ground contact of the lower portions of the raised boom during transport. The trailing wheel may provide other benefits including, for example, increased stability during transport and operation.

However, the trailing wheel may also, in some configurations, interfere with vehicle turning. For example, in order to turn some trenchers, the traction differential is typically released to first permit independent drive wheel movement. In order to permit transverse (turning) movement of the trailing wheel without turf scuffing, however, the operator usually applies a sufficient downward force to the control handle to lift the trailing wheel off the ground. While effective, repeated manipulation of the vehicle in this manner may become fatiguing. Furthermore, the trailing wheel may inadvertently drop into existing trenches and rats when the latter are traversed by the vehicle.

SUMMARY

The present invention may overcome these and other issues with conventional trenching machines by providing a walk-behind steerable trencher that, in one embodiment, includes: a frame; two independently powered and spaced-apart, ground-engaging drive members positioned on opposing sides of the frame; and a trenching boom. The trenching boom may include an elongate boom guide and an attachment arm defining a transverse pivot joint for pivotally attaching a proximal end of the boom guide to a forward portion of the frame, wherein the transverse pivot joint defines a first transverse axis. The boom may also include: an endless cutting element movable along a perimeter of the boom guide; and a drive emit for moving the cutting element along the perimeter of the boom guide, wherein the drive unit comprises a driven axle defining a second transverse axis that is offset from the first transverse axis. In this embodiment, the trencher may also include an actuator coupled between the frame and the trenching boom. The actuator is operable to pivot the trenching boom, about the first transverse axis, from an operating position, wherein a distal end of the boom is below a ground surface, to a transport position, wherein a lowermost portion of the cutting element is positioned above an inclined plane that extends upwardly, forwardly, and tangentially from a forwardmost portion of one of the ground-engaging drive members at an angle of 25 degrees or more from horizontal.

In another embodiment, a walk-behind steerable trencher is provided that includes: a frame having a forward end, a rearward end, and opposing sides; two independently powered and spaced-apart, ground-engaging tracks positioned on the opposing sides of the frame; and a trenching boom. The trenching boom may include an elongate boom guide; an attachment arm defining a transverse pivot joint for pivotally attaching a proximal end of the boom guide to the forward end of the frame, wherein the transverse pivot joint defines a first transverse axis; an endless cutting element movable along a perimeter of the boom guide; and a drive unit for moving the cutting element along the perimeter of the boom guide. The drive unit may include a driven axle defining a second transverse axis that is offset from the first transverse axis. The trencher may, in this embodiment, also include an actuator coupled to both the frame and the trenching boom. The actuator is operable to pivot the trenching boom, about the first transverse axis, from an operating position, wherein a distal end of the boom is below a horizontal ground surface, to a transport position, wherein a lowermost portion of the cutting element is positioned at an elevation of 5 inches or more above the horizontal ground surface.

In yet another embodiment, a walk-behind steerable trencher is provided. The trencher may include: a frame; two independently powered and spaced-apart, ground-engaging drive members positioned on opposing sides of the frame; and a trenching boom. The trenching boom may include: an attachment arm having a rearward portion attached to the frame for pivotal movement of the arm, relative to the frame, about a transverse frame pivot axis; an elongate boom guide pivotally attached to a forward portion of the attachment arm for pivotal movement of the boom guide, relative to the arm, about a transverse boom pivot axis; an endless cutting element movable along a perimeter of the boom guide; and a drive unit for driving the cutting element along the perimeter of the boom guide, wherein the drive unit comprises a driven axle coincident with the boom pivot axis. In this embodiment, the trencher may also include an actuator coupled between the frame and the trenching boom, wherein the actuator is configured to move the trenching boom, via pivotal motion about both the frame pivot axis and the boom pivot axis, from an operating position, wherein a distal end of the boom is below a ground surface, to a transport position, wherein the boom is positioned at a sufficient elevation above the ground surface for trencher transport.

The above summary is not intended to describe each embodiment or every implementation of the present invention. Rather, a more complete understanding of the invention will become apparent and appreciated by reference to the following Detailed Description of Exemplary Embodiments and claims in view of the accompanying figures of the drawing.

BRIEF DESCRIPTION OF THE VIEWS OF THE DRAWING

The present invention will be further described with reference to the figures of the drawing, wherein:

FIGS. 1A-1B are perspective views of a vehicle, e.g., a trencher, in accordance with one exemplary embodiment of the invention, wherein: FIG. 1A illustrates the trencher with a trenching boom in an operating position corresponding to the vehicle being in a trenching configuration; and FIG. 1B illustrates the trencher with the boom in a transport position corresponding to the vehicle being in a transport configuration;

FIGS. 5A-5B illustrate a trencher in accordance with an alternative embodiment of the present invention, the trencher incorporating a fill blade, wherein: FIG. 5A illustrates the blade in a ground engaging or operating location; and FIG. 5B illustrates the blade in a raised or transport location; and FIGS. 6A-6B illustrate a trencher in accordance with yet another embodiment of the invention, wherein: FIG. 6A is side elevation view with the trenching boom in a first operating position; and FIG. 6B is the same view with the trenching boom in a second transport position.

Figure 1A:
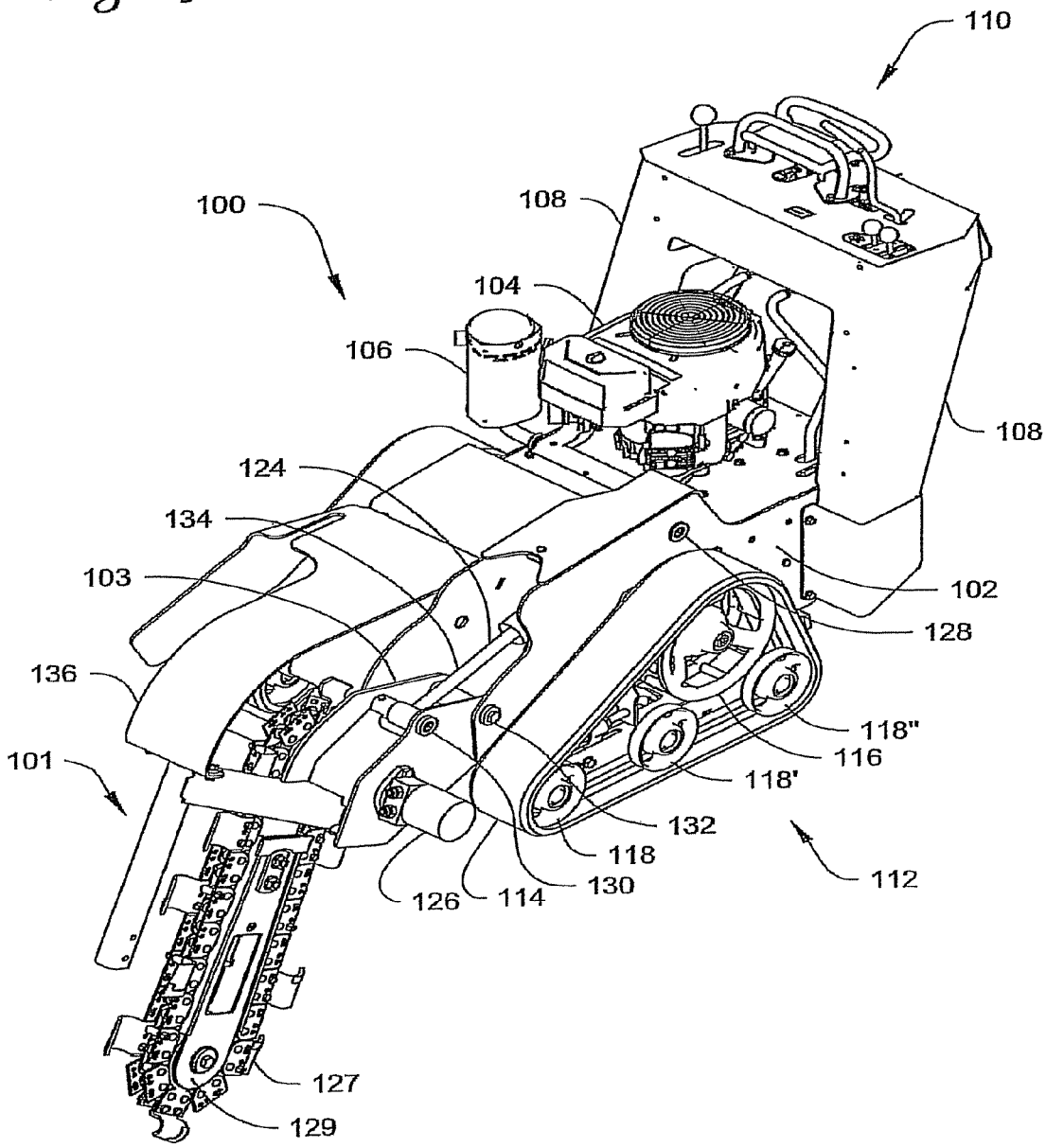

The figures are rendered primarily for clarity and, as a result, are not necessarily drawn to scale. Moreover, in some figures, various structure may be omitted for clarity.

DETAILED DESCRIPTION OF EXEMPLARY EMBODIMENTS

In the following detailed description of illustrative embodiments of the invention, reference is made to the accompanying figures of the drawing which form a part hereof, and in which are shown, by way of illustration, specific embodiments in which the invention may be practiced. It is to be understood that other embodiments may be utilized and structural changes may be made without departing from the scope of the invention.

Embodiments of the present invention may be directed to normally walk-behind, self-propelled working vehicles used, for example, to perform ground grooming or ground working operations. In one exemplary embodiment of the invention, the working vehicle is configured as a compact utility skid-steer vehicle which, in the illustrated embodiment, may be a dedicated walk-behind; steerable trenching vehicle 100 (also referred to herein as a "trencher") as shown in the Figures. The trencher 100 may be used, e.g., by landscape contractors, to form trenches in a ground surface for burying various items including, for example, electrical cables and irrigation pipe.

Those of skill in the art will realize that the trencher 100 is illustrative only as other embodiments of the present invention may be directed to vehicles configured for other dedicated and non-dedicated functions (e.g., tillers, snow throwers) as well as other vehicle configurations (e.g., ride-on vehicles, convertible loaders).

Figure 1B:
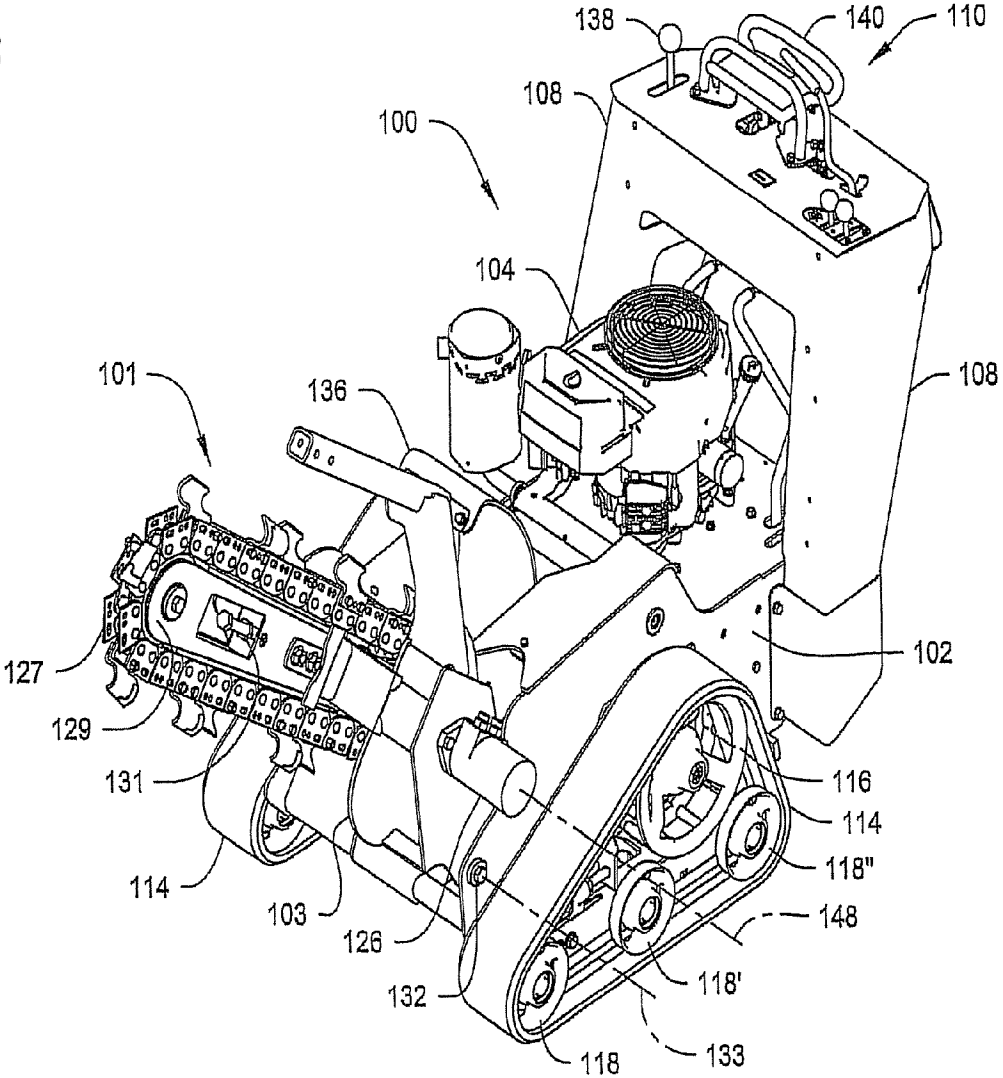

As shown in FIGS. 1A and 1B, the trencher 100 may include a suitably shaped frame 102 having a forward end, a rearward end, and opposing sides. A power source, such as an internal combustion engine 104, may be attached to the frame as illustrated. While the size of the engine 104 may vary depending on the particular trencher configuration, it may, in one embodiment, be approximately 10-25 horsepower. A muffler 106 may be provided and located to minimize exhaust output in the vicinity of the operator.

The trencher 100 may further include laterally spaced uprights 108 proximate a rear portion of the frame 102. The uprights 108 may form a handle system of the trencher that supports the trencher control area 110 proximate the rearward end of the frame as further described below. For more information on standard trenching machine nomenclature, refer to SAE J1382 (1982).

Figure 3A:
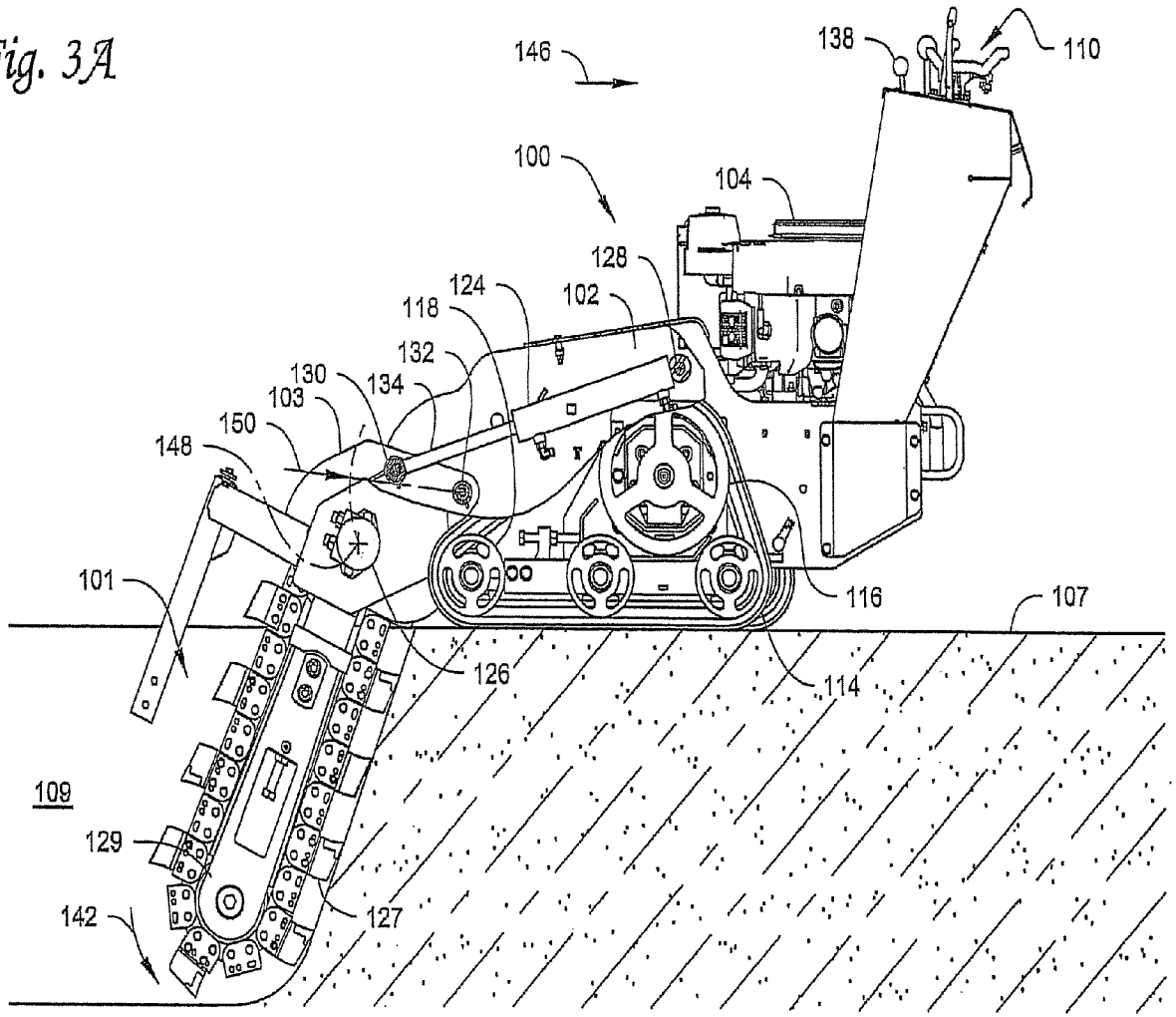
FIGS. 3A-3B are partial cut-away, side elevation views of the trencher of FIGS. 1A and 1B, respectively.

Pivotally attached to a forward portion of the trencher 100 is a trenching boom 101. The trenching boom 101, as described below, is operable to form a trench in a ground surface (e.g., horizontal ground surface 107 as shown in FIG. 3A). The boom 101 is movable between a fully extended or operating position (wherein a distil end of the boom is below a ground surface as shown in FIG. 1A, which corresponds to the trencher being in an operating configuration) and a fully retracted or transport position (see FIG. 1B, corresponding to the trencher being in a transport configuration). As further described below, the boom 101 may include an offset attachment arm 103 that pivotally attaches a proximal end of an elongate boom guide 129 to a forward end or portion of the trencher frame 102.

The vehicle 100 may further include a traction system 112 that includes both left and right powered drive members (e.g., two independently powered and spaced-apart, ground engaging tracks 114 on opposing sides of the frame 102 (only left track visible in FIG. 1A)) that are operable to propel or drive the trencher 100 along the ground surface 107. While shown as tracks, other-drive member configurations, e.g., wheels, are possible without departing from the scope of the invention. Each drive track 114 may be configured as an endless, flexible belt that is looped around a rear drive member or wheel 116 and at least one idler support member or wheel, e.g., forward idler wheel 118. In the illustrated embodiment, the rear drive wheel 116 is positioned at a higher elevation than the forward idler wheel 118. In order to provide the desired track configuration and length, the traction system 112 may also include support wheels 118' and 118".

The forward idler wheel 118 may be adjustable in the fore-aft direction to alter the tension on the drive track 114 as needed. Each drive track 114 may include inwardly extending drive lugs (not shown) that engage apertures or openings formed in each of the rear drive wheels 116. The drive lugs allow each wheel 116 to impart a driving force to its respective track to propel the trencher 100 in either the forward or reverse direction.

Figure 2:
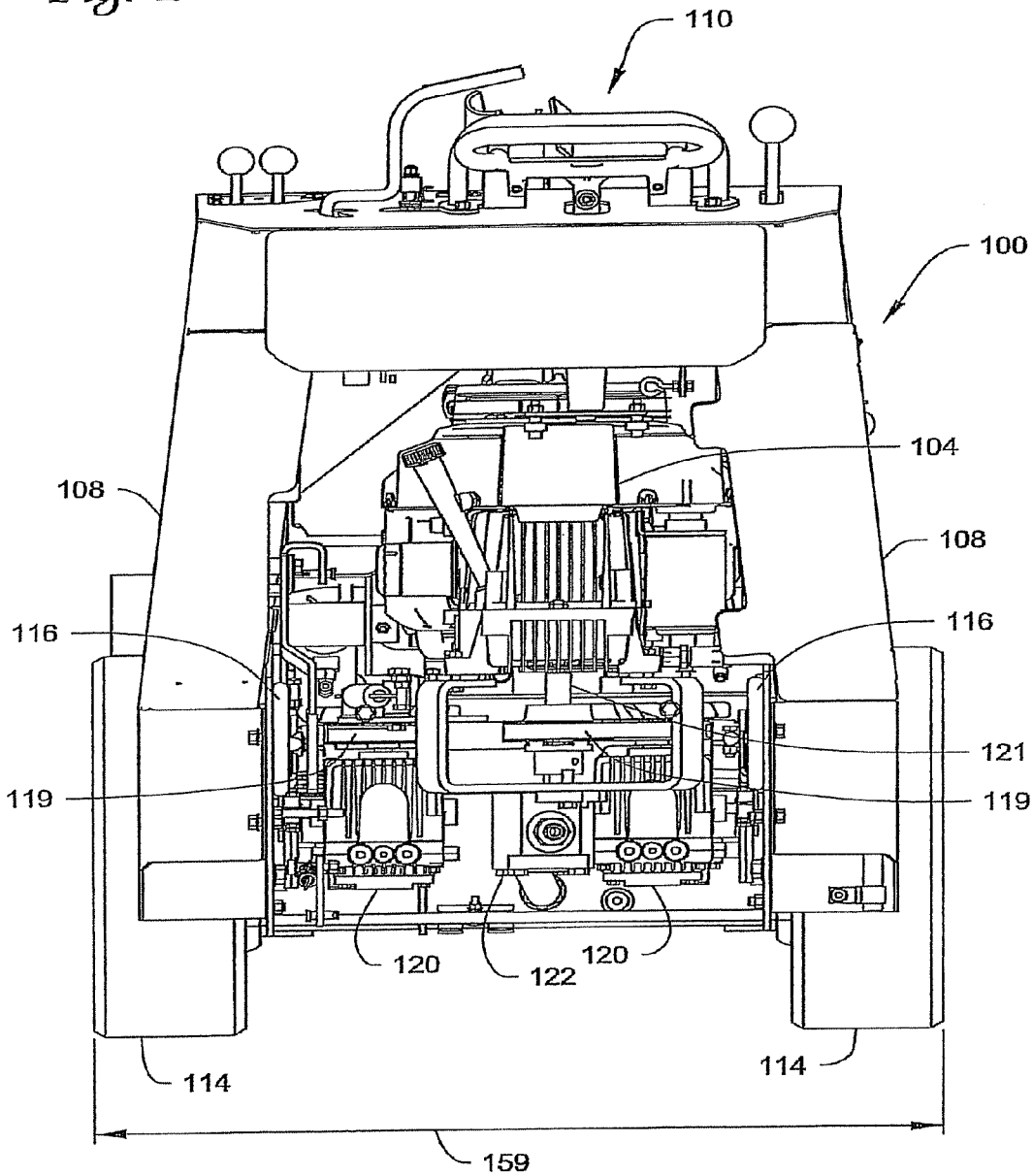
FIG. 2 is a rear elevation view of the trencher of FIG. 1B.

As shown more clearly in FIG. 2 (some structure removed for clarity), each drive wheel 116 may be driven by its own hydrostatic axle 120 coupled thereto (or by any other suitably motor or drive connection). Rotation of the rear drive wheels 116 (via the corresponding hydrostatic axle 120) may result in linear movement of the respective drive tracks 114 via engagement of the drive lugs of the track with the rear drive wheel. As is known in the art, each hydrostatic axle 120 may rotate its respective rear drive wheel 116 in either a forward (counterclockwise in FIG. 1A) or reverse (clockwise) direction to permit propelling of the trencher 100 either forwardly or in reverse. As each rear drive wheel 116 is powered by a separate hydrostatic axle 120, steering control of the trencher 100 may be achieved by varying the relative rotational speed and/or direction of each wheel 116, and thus the speed and direction of each track 114.

Each hydrostatic axle 120 may be powered by a belt 119 coupled to a vertical drive or output shaft 121 of the engine 104. A hydraulic pump 122 (see FIG. 2) may also be coupled to the output shaft 121 to power other components of the vehicle including an actuator, e.g., linear hydraulic cylinder 124 (see FIG. 1A), for raising and lowering the boom 101. In the illustrated embodiment, the cylinder 124 is coupled between the frame 102 and the trenching boom 101 and is operable to pivot the boom, about a first transverse pivot joint 132, e.g., about a first transverse axis 133 (see FIG. 1B), from the operating position to the transport position as further described below. To achieve this, the cylinder 124 may have its first or base end pivotally connected to the frame 102 at a base pivot joint 128 (see FIG. 3A), and a second or rod end pivotally attached to the boom 101 (e.g., to the arm 103) at a rod pivot joint 130. The rod pivot joint 130 may be radially offset from the first transverse axis 133 as shown in the figures.

When the cylinder is selectively extended, e.g., when a piston rod 134 of the hydraulic cylinder 124 is extended, the boom 101 may pivot about the first transverse pivot joint 132, e.g., about the axis 133, such that the boom moves towards the operating position of FIGS. 1A and 3A. Similarly, when the cylinder 124 (e.g., piston rod 134) is retracted, the boom 101 may pivot about the first transverse pivot joint 132, e.g., about the axis 133, such that it moves towards the transport position of FIGS. 1B and 3B. In other embodiments, the cylinder 124 may be positioned (e.g., such that the rod pivot joint 130 is below the transverse pivot joint 132 in FIG. 3A) such that extension of the cylinder 124 moves the boom 101 towards the transport position.

Figure 4:
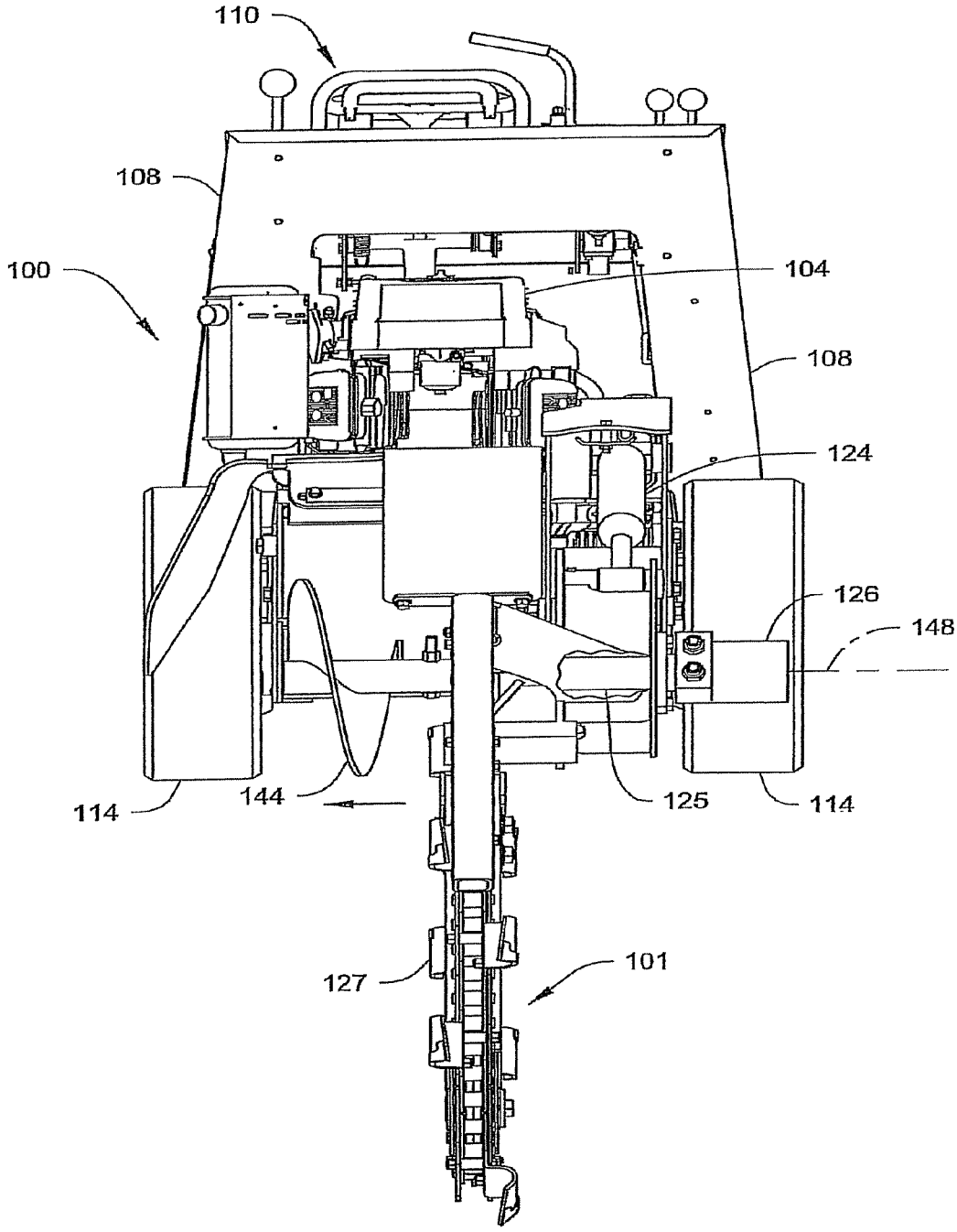
FIG. 4 is a front elevation view of the trencher of FIG. 1A.

The boom may further include a drive unit, e.g., hydraulic motor 126. The drive unit may move (e.g., translate) an endless cutting element such as an endless trenching chain 127 along a perimeter of the boom guide 129. In the illustrated embodiment, the hydraulic motor 126 is powered by the pump 122 (see FIG. 2). The motor 126 may include a driven axle 125 (see FIG. 4) to rotate at least a sprocket (not shown) that, in turn drives or moves the endless cutting element, e.g., trenching chain 127, along the perimeter of the boom guide 129 of the trenching boom 101. The distal end of the boom guide 101 may include an idler sprocket (also not shown). The distance between the two sprockets may be varied, e.g., via an adjustment mechanism 131, to control the tension in the chain.

Hydraulic fluid is ported from the pump 122 to the various hydraulic devices via conventional hydraulic conduits and/or hoses. However, for clarity, these conduits/hoses are not illustrated herein (although connection fittings may be illustrated).

FIGS. 1A and 1B further illustrate various guards that may be optionally included with the trencher 100. For example, a guard 136 may be attached to the boom 101 and move therewith between the operating and transport positions.

The control area 110 may be positioned and organized so that an operator standing behind the trencher 100 may comfortably locate both hands within the control area during operation and transport. The control area 110 may include various levers and the like that control the trencher. For example, a lever 138 may be provided to permit extension and retraction of the cylinder 124 (e.g., lowering and raising of the boom 101). In addition, the control area 110 may include a control handle 140 (see FIG. 1B) to control the traction system 112. Various other controls, e.g., trenching motor, throttle, operator presence control (OPC), etc., may also be provided. More information regarding exemplary control systems may be found in the '223 (Walto et al.) patent.

Figure 3B:
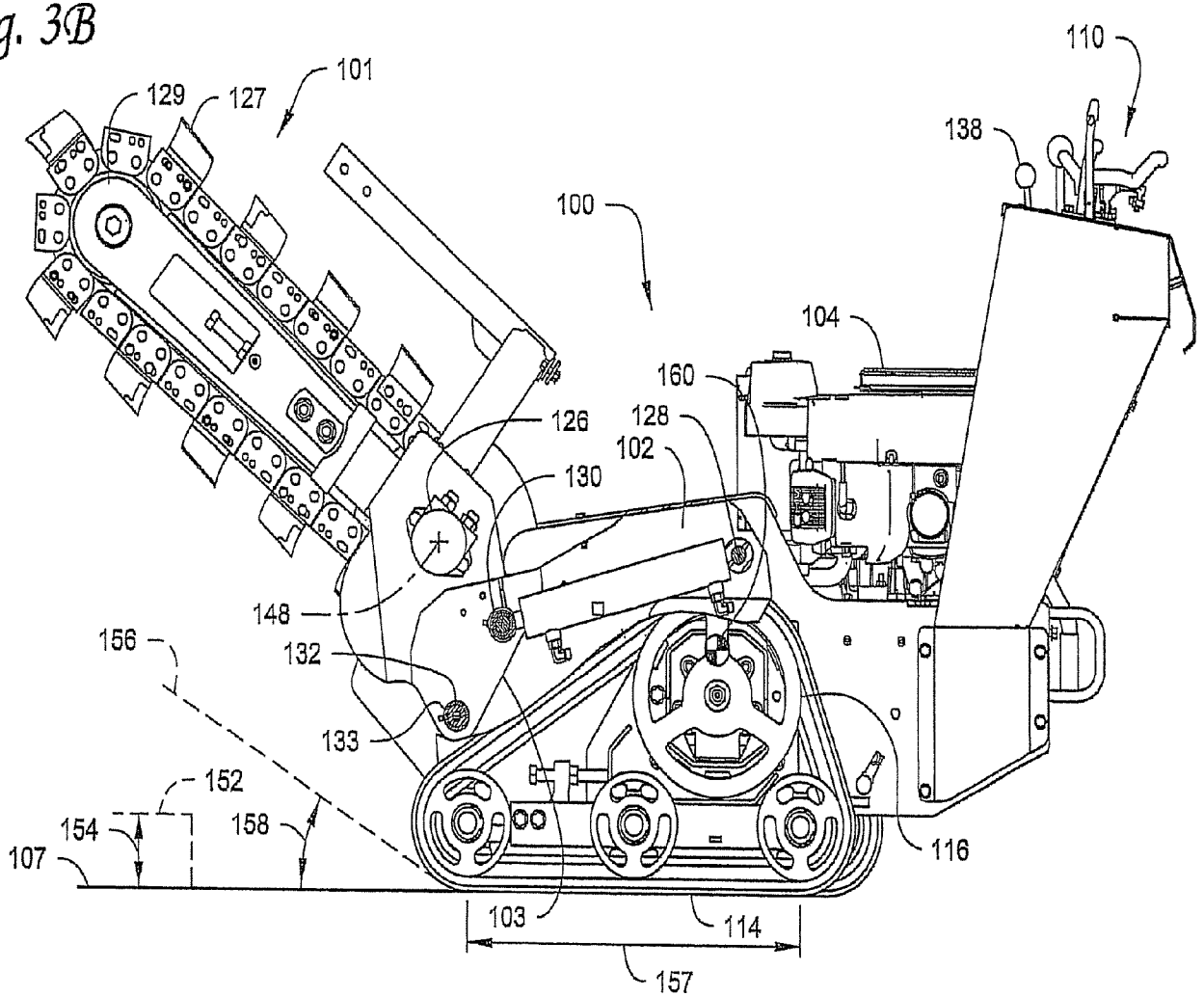

FIGS. 3A and 3B are cutaway side elevation views of the trencher 100 in both the operating position (FIG. 3A) and the transport position (FIG. 3B). During operation, the operator typically walks behind, the trencher 100 in a manner similar to that of a walk-behind lawn mower. Upon reaching the work area, the operator may manipulate the controls, e.g., lever 138, to extend the cylinder 124. As the cylinder extends, the boom 101 may move towards the operating position shown in FIG. 3A. While illustrated in its lowermost position in the FIG. 3A, the boom 101 may be located to produce a shallower trench by releasing the lever 138 when the boom reaches the desired depth. The trenching motor 126 may be actuated (e.g., via a control in the control area 110) as the boom is lowered to allow initial penetration into the ground surface 107.

As the trenching chain 127 moves along the guide 129 (as represented by arrow 142 in FIG. 3A), it digs into the ground surface 107 and transports displaced earthen material (e.g., soil) upwardly towards the front of the trencher. This material may then be moved laterally away from the trencher boom 101 (e.g., to the right side of the trencher) by a horizontal auger 144 (see FIG. 4) positioned laterally (e.g., offset to the side) from the proximal end of the boom and boom guide and coupled to a shaft powered by the motor 126. In the illustrated embodiment, the sprocket that drives the trenching chain 127 is attached to, and coaxial with, an axle of the auger 144 (an exemplary sprocket is described in U.S. Pat. No. 6,415,532 to Bricko et al.). As a result, as the trencher 100 is propelled in reverse; e.g., in the direction 146 indicated in FIG. 3A, the elongate trench 109 may be formed in the ground surface 107.

In the illustrated embodiment, the right track of the trencher 100 (opposite to the track in full view in FIG. 3A) may be offset longitudinally (towards the rear of the unit as compared to the opposing left track) by a short distance, e.g., 2 inches. This-offset may, among other advantages, better accommodate the auger 144 and dirt shield (the latter not shown) out to, or beyond, the edge of the trencher. In the illustrated embodiment, the right track is otherwise identical to (e.g., a mirror image of) the left track except for being subject to this rearward shift of 2 inches.

At the completion of the trench forming operation, the operator may manipulate the lever 138 to cause the cylinder 124 to retract and move the boom 101 from the operating position of FIG. 3A to the transport position illustrated in FIG. 3B. Hydraulic flow to the motor 126 may be terminated before or during movement of the boom. With the boom 101 removed from the ground, the trencher may be maneuvered (e.g., turned, propelled forwardly or rearwardly, etc.) to position it at the correct location for the next trenching operation.

In contrast to some trenching vehicles, the trencher 100 is able to achieve repositioning of the boom between the operating position and the transport position with the use of a single mechanism, e.g., cylinder 124. Moreover, the trencher 100 is capable of both trenching operation and transport without the need for a conventional trailing wheel forward of the aft end of the boom.

These capabilities are at least partially attributable to the geometry of the exemplary trencher 100 as illustrated in FIGS. 3A and 3B. With reference to these figures, the offset attachment arm 103 of the boom 101 may be configured to pivot near an aft end of the arm, relative to the frame 102, about the first transverse axis 133 (see also FIG. 1B). The motor 126 that drives the chain 127 and auger 144, however, may be attached to a relatively more forward portion of the arm 103 (as viewed when the boom is in the operating position of FIG. 3A). The driven axle 125 (see FIG. 4) of the motor 126 may define a second transverse axis, e.g., a boom or trencher pivot axis 148, that is parallel to, and offset from, the first transverse axis 133 by a distance 150 (see FIG. 3A). Accordingly, the motor 126 and auger 144 may pivot, relative to the frame 102, as the boom is moved. While the offset distance 150 may vary depending on the particular trencher configuration, it is in one embodiment about 10 inches. In this configuration, the hydraulic cylinder 124 may displace or pivot the boom 101 at least about 100 degrees between the operating position and the transport position.

As a result of the offset pivot joint 132, movement of the boom 101 between the operating position of FIG. 3A and the transport position of FIG. 3B results in pivotal movement of all portions of the boom 101 (including the motor 126, chain 127, and auger 144) away from the ground. As a result, the trencher 100 has clearance adequate to permit traversal of various obstacles/surfaces without the need for the conventional trailing wheel. For example, when the trencher 100 is in the transport configuration as shown in FIG. 3B (e.g., the boom 101 is in the transport position), a lowermost portion of the boom, e.g., the cutting element or chain 127, may be positioned at an elevation of 5 inches or more above the horizontal ground surface 107. As a result, it may traverse a curb 152 having a typical height 154 of 5 inches or more, e.g., about 6 inches, without any part of the trencher or boom bottoming out or otherwise scraping the curb.

Similarly, when the boom is in the transport position, a lowermost portion of the boom, e.g., the cutting element or chain 127, is positioned above an inclined plane 156 that extends upwardly, forwardly, and tangentially from a forwardmost portion of one or both of the ground engaging tracks (e.g., the most forwardly positioned track) at an angle 158 of about 25 degrees or more from horizontal. As a result, the trencher 100 may climb an inclined surface, e.g., a trailer ramp, having an approach angle 158 of about 25 degrees or more, e.g., about 30 degrees, without any part of the trencher or boom bottoming out. Higher angles may be accommodated, but may be otherwise limited by various aspects (e.g., center of gravity) of the vehicle.

Elimination of the trailing wheel may provide additional benefits. For example, construction of the trencher may be simplified due to corresponding component elimination. Moreover, trenchers in accordance with embodiments of the present invention may be well suited for traversing existing trenches without concern for trailing wheel drop-in as may occur with some trailing wheel configurations.

Embodiments of the present invention may furthermore incorporate vertical engine 104 mounting, potentially providing for more compact and efficient hydraulic and drive belt routing, as well as desirable visibility of the trenching area. As a result, a short and compact trencher may be provided. For instance, in one exemplary embodiment, the trencher 100 has a track length 157 (see FIG. 3B) of about 23 inches (measured from centers-of the front and rear idler wheels 118) and a track width 159 (see FIG. 2) of about 33.2 inches. In one embodiment, a center of gravity (CG) of the trencher 100 is located longitudinally within the span of both tracks. For instance, with a two foot boom 101 (and chain) and the boom in the transport position, the CG (see reference numeral 160 in FIG. 3B) may be located rearward of the axle of the left front wheel 118 (the most forward wheel 118) by a distance of about 15.5 inches. It may further be located transversely about 2 inches left of center and at an elevation of about 17.5 inches from the ground.

Figure 5A:
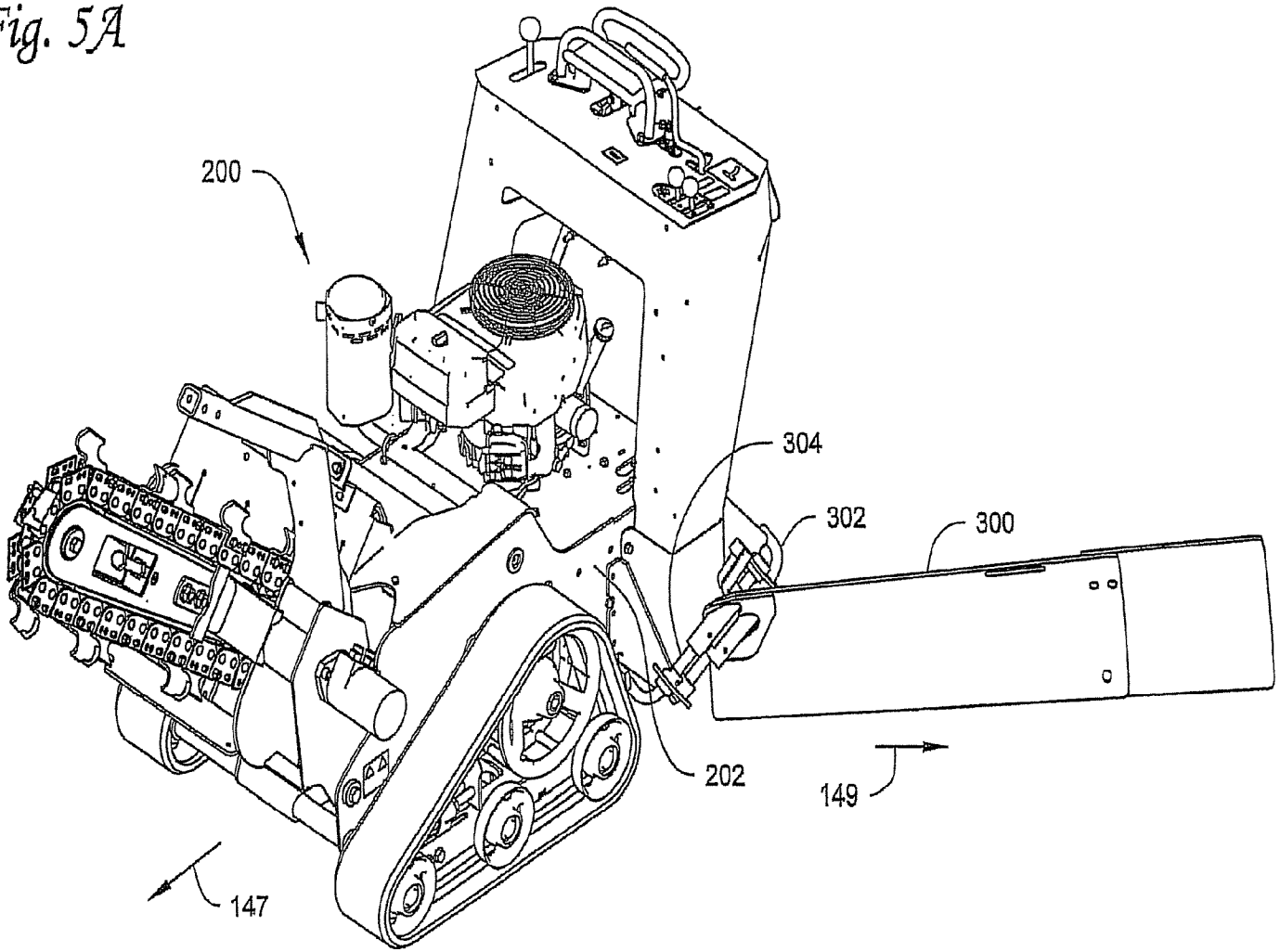
Figure 5B:
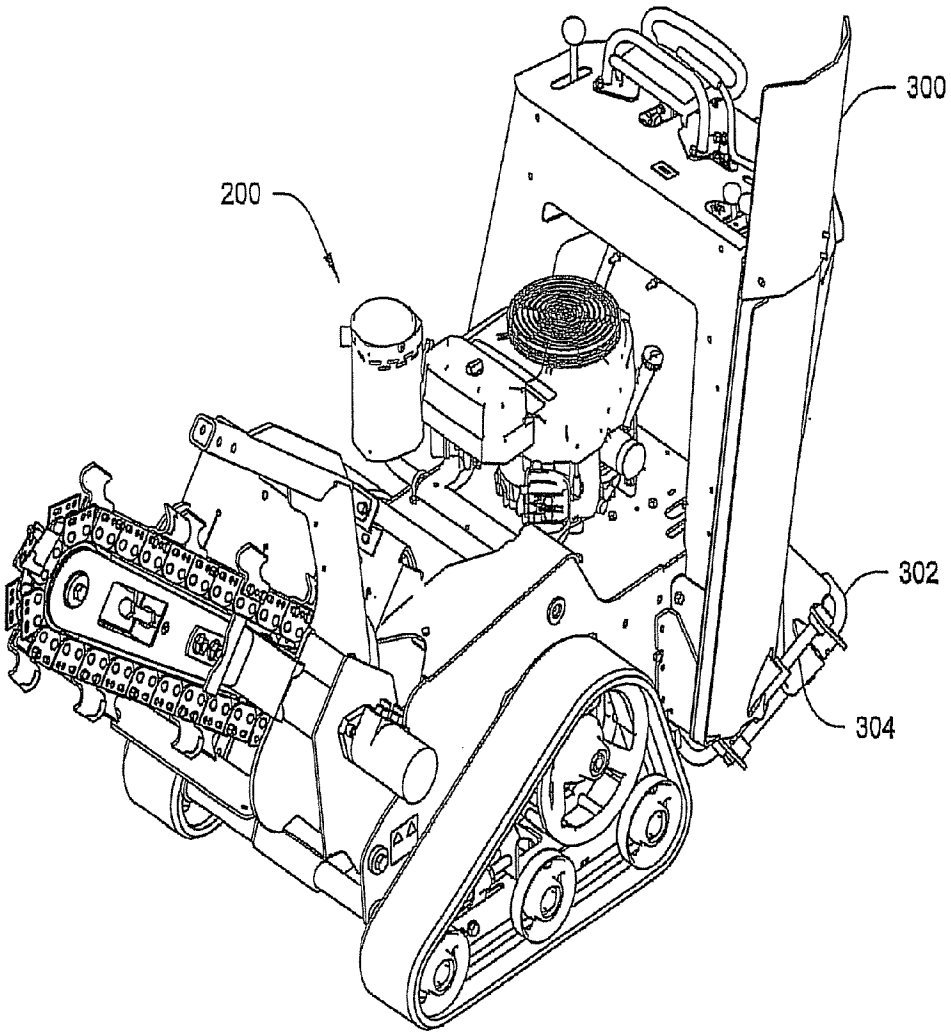

FIGS. 5A and 5B illustrate a trencher 200 in accordance with an alternative embodiment of the invention. In this embodiment, the trencher 200 is generally configured the same as the trencher 100 already described herein. However, the trencher 200 may additionally include an optional fill blade 300. The fill blade 300 may attach, e.g., permanently or temporarily, to a frame 202 of the trencher. The fill blade 300 may be moved, e.g., pivoted, between an operating position or location as shown in FIG. 5A, and a storage position or location as shown in FIG. 5B. In the operating position, the fill blade 300 may extend obliquely from one side of the trencher and be close to or in contact with the ground surface. As the trencher 200 moves in the forward direction 147 parallel to, but offset from (e.g., along the side of), the trench (not shown), the fill blade 300 may push dirt and other earthen material previously removed by the trencher in the direction 149 and back into the trench (see FIG. 3A). In the storage location, the fill blade 300, while still attached to the trencher, may extend upwardly as shown in FIG. 5B.

The blade 300 may be immobilized or locked in either the storage or operating location by a pair of pins 302 and 304 that couple to the frame 202 of the trencher 200. For example, the blade 300 may include shaped openings or hubs (see FIG. 5A) through which the two angled pins 302, 304 pass. In the operating location, the pins 302, 304 may, via the shaped openings, lock the blade 300 in the position illustrated in FIG. 5A. Even when locked in the operating position, however, the blade 300 may slide or translate upwardly and downwardly along the pins 302, 304 to allow the blade to traverse ground undulations. To move the blade to the storage location, the lower pin 302 may be removed and the blade 300 pivoted about the upper pin 304 to the position illustrated in FIG. 5B. At this point, the lower pin 302 may be reinserted into another hub or opening in the blade to secure or lock it in the storage location. While described herein as a dual pin mechanism, other embodiments, e.g., simple pivoting configurations, are certainly possible without departing from the scope of the invention.

Figure 6A:
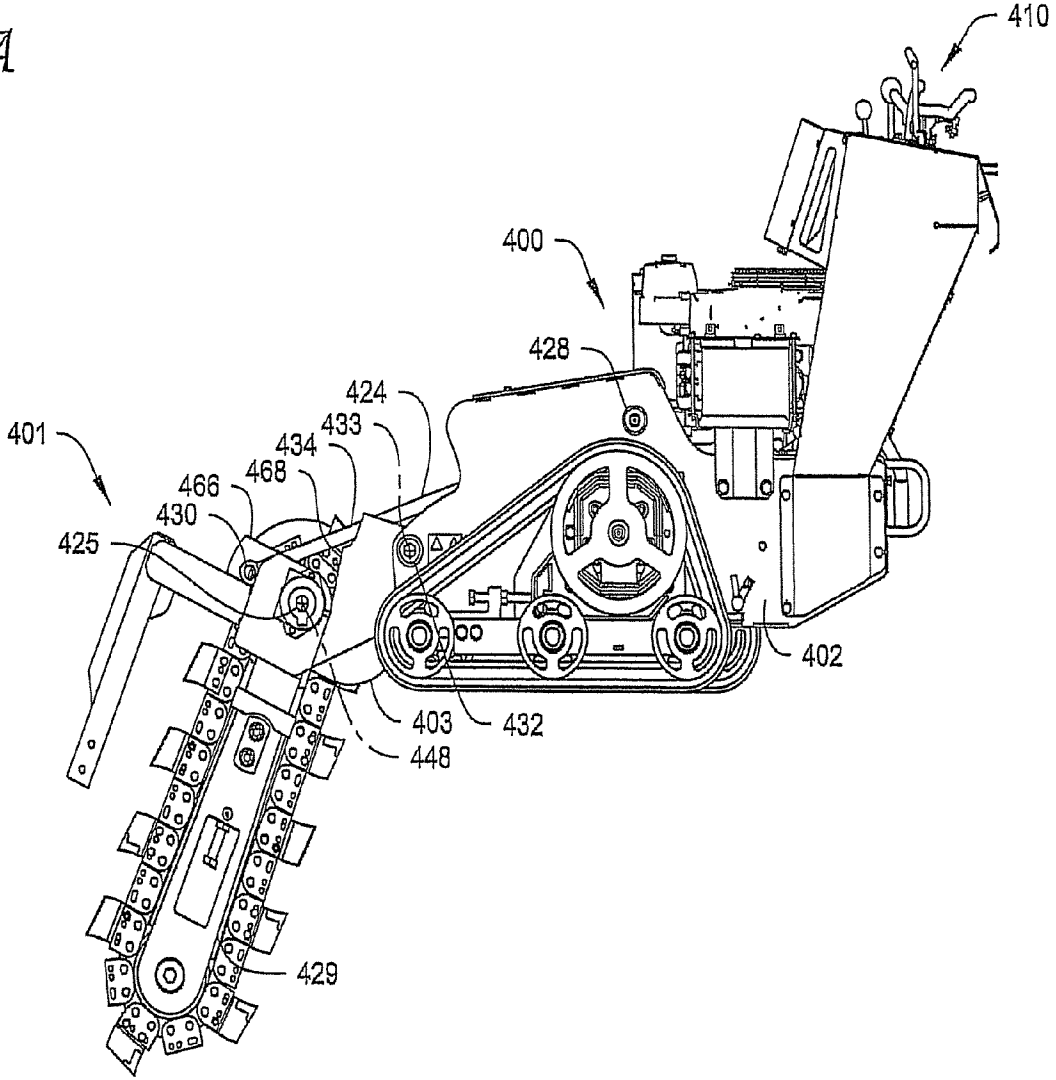
Figure 6B:
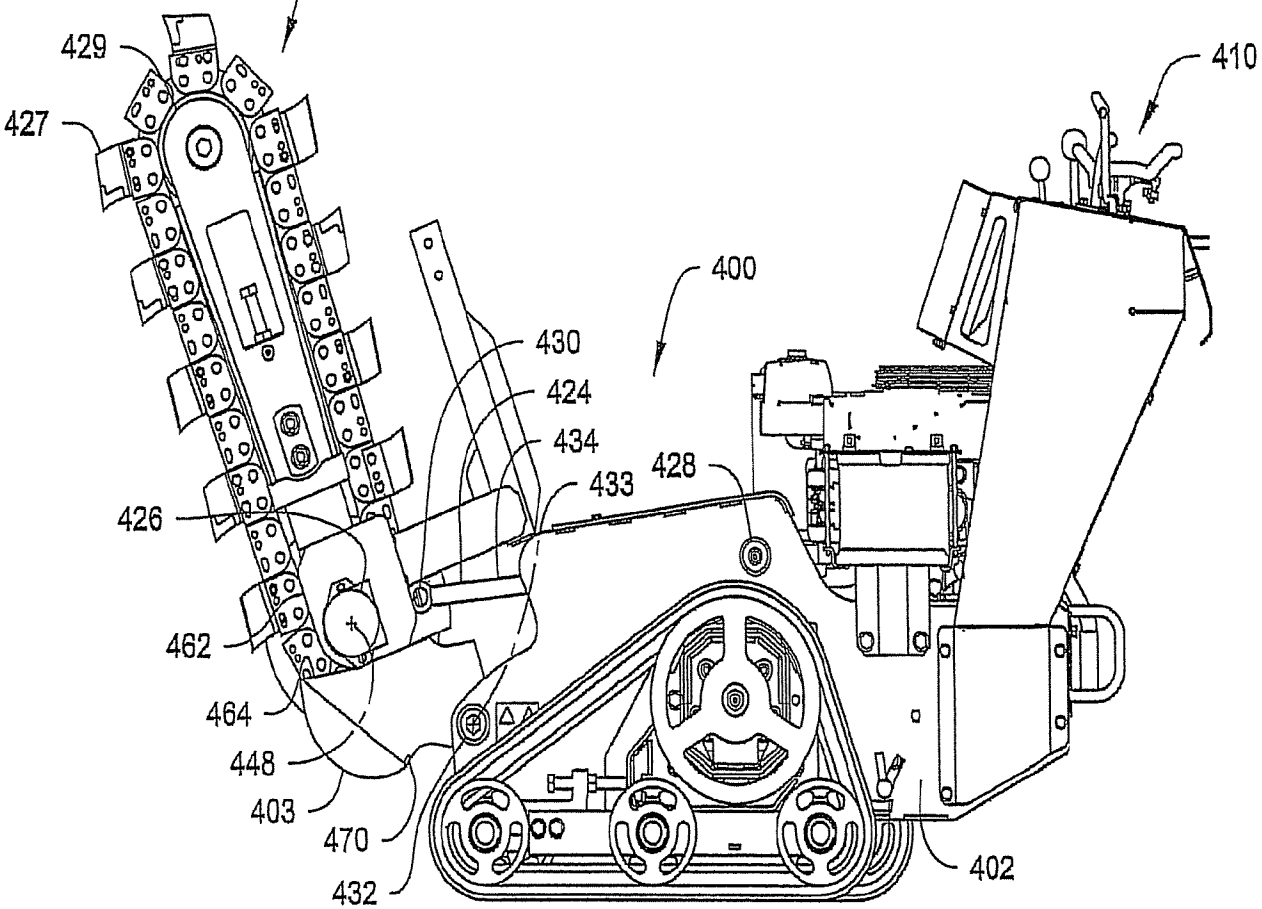

FIGS. 6A and 6B illustrate a vehicle, e.g., trencher 400, in accordance with another embodiment of the invention. Except where noted below, the trencher 400 may be configured in a manner substantially similar to the trencher 100 already described above and, as a result, further description of common aspects is not provided.

Unlike the trencher 100, however, the trencher 400 may include a trenching boom 401 that attaches to the trencher via a dual pivot mechanism. For instance, the boom 401 may, once again, include an attachment arm 403 and a boom guide 429. However, in this embodiment, the boom guide is pivotally attached to a forward portion of the arm 403 such that the boom 401 (e.g., boom guide 429) may also pivot, relative to the arm, about a second transverse or boom pivot axis 448 (the latter which may be coincident with a driven axle 425 of a trenching motor 426). Like the arm 103, the arm 403 may, in turn, have a rearward portion pivotally attached to a frame 402 of the trencher 400 at a first transverse pivot joint 432 for pivotal movement of the arm, relative to the frame, about a first transverse or frame pivot axis 433 that, in one embodiment, is parallel to the boom pivot axis 448.

The boom 401 may be movable between an operating position as shown in FIG. 6A and a transport position as shown in FIG. 6B via a hydraulic cylinder 424 that is substantially similar to the cylinder 124 described above. The cylinder may attach to the frame 402 of the trencher 400 at a base pivot joint 428 and to the boom, e.g., boom guide 429, at a rod pivot joint 430. By extending and retracting a piston rod 434 of the cylinder 424 as described above with reference to the trencher 100 and cylinder 124, the boom 401 (e.g., boom guide 429) may be moved between the operating and transport positions via pivotal motion about both the frame pivot axis 433 and the boom pivot axis 448 as further described below. Controls for the hydraulic cylinder 424 (as well as other systems of the trencher 400) may be located in a control area 410.

During transport, the trencher 400 may be configured as illustrated in FIG. 6B. Upon reaching the trenching site, the boom 401 could be lowered by extending the hydraulic cylinder 424. In one embodiment, as the cylinder extends, the guide 429 may begin to pivot (e.g., counterclockwise in FIG. 6B) about the boom pivot axis 448. When a first contact or stop surface 462 of the guide 429 contacts a second contact or stop surface 464 of the arm 403, the arm 403 may begin to pivot, in the counterclockwise direction in FIG. 6B, about the frame pivot axis 433 of the pivot joint 432. Further extension of the hydraulic cylinder may result in the boom 401 moving fully to the operating position of FIG. 6A.

To return the boom 401 to the transport position (or any position between the operating position and the transport position), the hydraulic cylinder 424 may be retracted. As the cylinder retracts, the arm 403 may begin to move in the clockwise direction in FIG. 6A about the frame pivot axis 433 of the pivot joint 432. Once the arm 403 reaches its limit, the guide 429 may begin to pivot, clockwise in FIG. 6A, until a third contact or stop surface 466 of the guide contacts a fourth contact or stop surface 468 of the arm.

It is noted that, while described herein as moving in a particular order, those of skill in the art will note that both the boom 429 and the arm 403 may move in a difference sequence or even in unison. In fact, in a different embodiment (e.g., the illustrated embodiment), the arm 403 may be biased for movement downwardly (in a counterclockwise direction as viewed in FIGS. 6A and 6B) about the pivot joint 432, e.g., via a rotating cam lock or a biasing member such as a spring. As a result, the arm 403 may pivot first about the pivot joint 432 when the boom 401 is moved from the transport position towards the operating position. After the arm reaches its lower position; e.g., an abutting surface 470 of the arm 403 (see, e.g., FIG. 6B) contacts a corresponding abutting surface the frame 402, pivoting of the boom guide about the boom pivot axis 448 may commence. Stated another way, the arm 403 may "bottom out" in travel before pivoting of the boom guide 429 about the boom pivot axis 448 occurs.

Similarly, when the boom 401 is moved from a lower position (e.g., the operating position) towards the transport position, the bias of the arm 403 may cause the boom (e.g., boom guide) to initially pivot about the boom pivot axis 448 until the third contact surface 466 contacts the fourth contact surface 468. After contact between the surfaces 466 and 468, the boom may pivot about the pivot joint 432 as it moves towards the transport position. The upward position of the boom 401 may be limited by either the stroke of the cylinder 424, or by contact between surfaces of the arm 403 and the frame 402.

The latter biased arm con figuration ensures that all or most of the operating positions of the boom (e.g., operating positions short of the full down position illustrated in FIG. 6A) will still locate the axis 448 (and thus the auger (see, e.g., auger 144 in FIG. 4)) close to the ground surface.

The trencher 400 is configured to locate the boom in a transport position that is similar to that described with respect to the trencher 100, e.g., positioned to traverse a curb of 5 inches or more in height or climb an incline of 25 degrees or more without bottoming out.

As stated elsewhere herein, while the invention is described in the context of a dedicated trencher, alternative embodiments may encompass other types of vehicles. For instance, the vehicle could be configured substantially as shown, but with an attachment plate in place of the boom. The attachment plate could be configured to receive a variety of attachments as are already known in the art.

The complete disclosure of the patents, patent documents, and publications cited in the Background, the Detailed Description of Exemplary Embodiments, and elsewhere herein are incorporated by reference in their entirety as if each were individually incorporated.

Illustrative embodiments of this invention are discussed and reference has been made to possible variations within the scope of this invention. These and other variations, combinations, and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

What is claimed is:

1. A walk-behind steerable trencher, comprising:

a frame defining a stationary pivot joint located near a forward end of the frame;

two independently powered ground-contacting tracks, one located on each of a first and a second side of the frame; and a trenching boom comprising:

an elongate boom guide;

an endless cutting element movable along the boom guide; and an attachment arm comprising a forward end attached to the boom guide and an aft end pivotally attached to the frame at the pivot joint, wherein the attachment arm is configured to offset the boom guide relative to the frame, the trenching boom operable to pivot, relative to the frame and about the pivot joint, between: an operating position, wherein at least a portion of the cutting element is positioned below a ground surface upon which the tracks rest; and an elevated transport position, wherein the boom is suspended forward of the forward end of the frame and above the ground surface at an elevation adequate to prevent contact of the boom with the ground surface during trencher transport over the ground surface, and wherein the two tracks alone are configured to contact the ground surface when the trenching boom is in the transport position.

2. The trencher of claim 1, wherein each track is looped around a forward idler wheel and a powered drive wheel, the drive wheel positioned at an elevation higher than the forward idler wheel.

3. The trencher of claim 2, wherein each drive wheel is coupled to a separate hydrostatic axle.

4. The trencher of claim 1, further comprising an actuator coupled between the frame and the trenching boom, the actuator operable to pivot the trenching boom about the pivot joint between the operating position and the transport position.

5. The trencher of claim 4, wherein the actuator comprises a linear hydraulic cylinder.

6. The trencher of claim 4, wherein a first end of the actuator is attached to the frame, and a second end of the actuator is attached to the attachment arm.

7. The trencher of claim 1, further comprising an engine attached to the frame, the engine oriented such that a drive shaft of the engine is vertical.

8. The trencher of claim 1, wherein one track is longitudinally offset relative to the other track.

9. The trencher of claim 1, wherein, when the trenching boom is in the transport position, a lowermost portion of the cutting element is positioned above an inclined plane that extends upwardly, forwardly, and tangentially from a forward portion of one of the tracks at an angle of 25 degrees or more from horizontal.

10. The trencher of claim 1, wherein, when the trenching boom is in the transport position, a lowermost portion of the cutting element is positioned at an elevation of 5 inches or more above the ground surface.

11. The trencher of claim 1, wherein the trenching boom further comprises a drive unit for moving the cutting element along the boom guide, the drive unit comprising a driven axle defining an axis that is parallel to, and offset from, an axis of the pivot joint.

12. The trencher of claim 11, further comprising a horizontal auger powered by the drive unit.

13. A walk-behind steerable trencher, comprising:

a frame comprising a forward end and left and right sides, the frame defining a pivot joint located near the forward end;

two independently powered ground-contacting tracks, one located on each of the left and right sides of the frame; and a trenching boom comprising:

an elongate boom guide;

an endless cutting element movable along the boom guide; and an attachment arm extending from the boom guide, the attachment arm pivotally attached to the frame at the pivot joint such that movement of the boom guide relative to the frame is limited to pivotal movement of the trenching boom about the pivot joint, wherein the attachment arm is configured to offset the boom guide relative to the frame;

the trenching boom operable to pivot, relative to the frame and about the pivot joint, between: an operating position, wherein at least a portion of the cutting element is positioned below a ground surface upon which the tracks rest; and an elevated transport position, wherein the boom is suspended forward of the forward end of the frame and above the ground surface at an elevation adequate to prevent contact of the boom with the ground surface during trencher transport over the ground surface, and wherein the two tracks alone are configured to support the trencher upon the ground surface when the trenching boom is in the transport position.

14. The trencher of claim 13, further comprising an actuator coupled between the frame and the attachment arm, the actuator operable to pivot the trenching boom about the pivot joint between the operating position and the transport position.

15. The trencher of claim 14, wherein the actuator comprises a linear hydraulic cylinder.

16. The trencher of claim 13, further comprising an engine attached to the frame, the engine oriented such that a drive shaft of the engine is vertical.

17. The trencher of claim 13, wherein one track is longitudinally offset relative to the other track.

18. The trencher of claim 13, further comprising a fill blade attached to either the left or right side of the frame.

19. The trencher of claim 13, further comprising a horizontal auger attached to the trenching boom.

20. The trencher of claim 19, further comprising a drive unit configured to both: move the cutting element along the boom guide; and power the auger.

* * * * *